US010145075B2

(12) United States Patent
Isham et al.

(10) Patent No.: US 10,145,075 B2
(45) Date of Patent: Dec. 4, 2018

(54) MULTILAYER MARINE WRAPS

(71) Applicant: MedVasis, LLC, Houston, TX (US)

(72) Inventors: John Isham, Houston, TX (US); Tamsen Valoir, Houston, TX (US)

(73) Assignee: MedVasis, LLC, Houston, TX (US)

( * ) Notice: Subject to any disclaimer, the term of this patent is extended or adjusted under 35 U.S.C. 154(b) by 417 days.

(21) Appl. No.: 14/517,490

(22) Filed: Oct. 17, 2014

(65) Prior Publication Data

US 2015/0132067 A1 May 14, 2015

Related U.S. Application Data

(60) Provisional application No. 61/904,203, filed on Nov. 14, 2013.

(51) Int. Cl.

| | |
|---|---|
| ***E02B 17/00*** | (2006.01) |
| ***B63B 59/00*** | (2006.01) |
| ***E02B 3/20*** | (2006.01) |
| ***E02B 3/16*** | (2006.01) |
| *E02B 3/06* | (2006.01) |
| *B63B 59/04* | (2006.01) |

(52) U.S. Cl.
CPC ..... *E02B 17/0017* (2013.01); *E02B 3/16* (2013.01); *B63B 59/04* (2013.01); *E02B 3/068* (2013.01); *E02B 3/20* (2013.01)

(58) Field of Classification Search
CPC ..... B32B 2255/00; Y10T 156/12
USPC ..... 405/211, 211.1, 213
See application file for complete search history.

(56) References Cited

U.S. PATENT DOCUMENTS

| | | | | |
|---|---|---|---|---|
| 2,005,665 | A * | 6/1935 | Saignier | B65D 77/36 229/123.2 |
| 2,724,156 | A | 11/1955 | Shaw | |
| 2,771,385 | A * | 11/1956 | Humphner | B65B 61/182 229/123.2 |
| 2,954,139 | A * | 9/1960 | Owens | B65D 55/0854 215/246 |
| 3,746,201 | A * | 7/1973 | Fujio | B65D 45/00 215/246 |
| 4,076,373 | A * | 2/1978 | Moretti | A61F 9/025 2/434 |
| 5,087,154 | A * | 2/1992 | Crawford | E02B 17/0026 405/211 |
| RE34,024 | E * | 8/1992 | Kim | B65D 27/38 229/311 |
| 5,180,531 | A | 1/1993 | Borzakian | |
| 5,298,060 | A | 3/1994 | Harakal | |
| 5,516,236 | A * | 5/1996 | Williams | E02D 5/60 405/211 |
| 5,633,057 | A * | 5/1997 | Fawley | B29C 53/562 428/105 |
| 5,916,654 | A * | 6/1999 | Phillips | E04D 5/12 428/40.1 |

(Continued)

OTHER PUBLICATIONS

Mullins, Gray; Sen, Rajan; Suh, Kwang Suk. Concrete International, Jan. 2006, vol. 28 Issue 1, p. 70-73, 4p.*

(Continued)

*Primary Examiner* — Tara Mayo-Pinnock
(74) *Attorney, Agent, or Firm* — Boulware & Valoir

(57) ABSTRACT

A multilayer marine wrapping is proposed wherein each layer has a removal strip and the removal strips are staggered, such that a single layer can be removed at a time.

17 Claims, 5 Drawing Sheets

(56) References Cited

U.S. PATENT DOCUMENTS 6,127,014 A * 10/2000 McKay, Jr. ..... A47L 25/005 15/104.002
6,235,365 B1 * 5/2001 Schaughency ..... E04D 5/12 428/114
6,872,030 B2 3/2005 Ashton
6,964,141 B2 * 11/2005 Igarashi ..... E04G 23/0218 156/71
7,037,980 B2 5/2006 Stacy
7,300,229 B1 11/2007 Fyfe
7,476,056 B2 * 1/2009 Dreyer ..... F16L 55/0336 405/211
7,871,483 B2 1/2011 Mullins
7,914,638 B2 3/2011 Van Den Berghe
8,187,407 B2 5/2012 Van Den Berghe
8,361,615 B2 1/2013 Van Den Berghe
8,511,472 B2 8/2013 Dupuis
2003/0039824 A1 * 2/2003 Aalbers ..... A47L 25/005 428/343
2004/0240943 A1 * 12/2004 Brensinger ..... E02D 5/60 405/211
2006/0088386 A1 * 4/2006 Ellis ..... E02D 5/60 405/211.1
2009/0104424 A1 * 4/2009 Manrique ..... B32B 27/32 428/220
2011/0098401 A1 4/2011 Müller
2012/0298734 A1 * 11/2012 Bradshaw ..... C09J 7/04 229/212

OTHER PUBLICATIONS

Bruijs, M.C.M., Pre-survey of marine fouling on turbine support structures of the Offshore Windfarm Egmond aan Zee (2006), available online at noordzeewind.nl/wpcontent/uploads/2012/02/OWEZ_R_112_20060725.pdf.

* cited by examiner

| PILING | $kg/m^2$ | PERCENT COVERAGE | BIOFOULING ORGANISMS |
|---|---|---|---|
| BARE STEEL (UNSHEATHED CONTROL) | | | |
| 5 YEARS<br>10 YEARS | 18.00<br>12.00 | 100.0<br>100.0 | Massive barnacles, oysters, codium, sea liver, clams, sea urchin, coral, filimentous bryozoans |
| CONCRETE-INSULATED Cu-Ni ON STEEL | | | |
| 5 YEARS<br>10 YEARS | 0.36<br>0.14 | 1.9<br>1.2 | Only scattered barnacle shells |
| CuNi DIRECTLY WELDED TO STEEL | | | |
| 5 YEARS<br>10 YEARS | 7.95<br>4.43 | 44.3<br>36.8 | Moderate barnacles, oysters, codium, sea liver, sponge, filimentous bryozoans, colonial tunicate |
| RUBBER INSULATED Cu-Ni ON STEEL | | | |
| 5 YEARS<br>10 YEARS<br>(AVERAGE 3 PILINGS) | 0.26<br>0.51 | 1.4<br>4.2 | Scattered barnacles, oysters, codium, colonial tunicate, filimentous bryozoans |
| RUBBER INSULATED Cu-Ni ON STEEL WITH GALVANIC COUPLE (SINGLE POINT CONTACT) | | | |
| 5 YEARS<br>10 YEARS<br>(AVERAGE 2 PILINGS) | 4.59<br>7.7 | 25.5<br>42.8 | Moderate barnacles, oysters, codium, tunicate, colonial tunicate, encrusting and filimentous bryozoans |

FIG. 2

MULTILAYER MARINE WRAPS

This application claims priority to U.S. Ser. No. 61/904,203, filed Nov. 14, 2013 and expressly incorporated by reference in its entirety for all purposes.

FEDERALLY SPONSORED RESEARCH STATEMENT

Not applicable.

REFERENCE TO MICROFICHE APPENDIX

Not applicable.

FIELD OF THE DISCLOSURE

The disclosure generally relates to method of protecting marine pilings and other marine equipment from corrosion and barnacle infestation, and to quick and easy means of removing same without expensive downtime or expensive underwater cleaning operations.

BACKGROUND OF THE DISCLOSURE

Marine pilings and other equipment are subject to constant attack by salt water, erosive forces by waves, and the constant threat of biofouling and the damaging effects of marine growth. All of these severe forces limit the lifespan of marine equipment of all kinds.

According to some estimates, over 1700 species comprising over 4000 organisms are responsible for biofouling. Biofouling is divided into two types. Microfouling—biofilm formation and bacterial adhesion—and macrofouling—attachment of larger organisms (see e.g., FIG. 1 showing the various layers of biofouling as well as damage to the support structure). Due to the distinct chemistry and biology that determines what prevents them from settling, organisms are also classified as hard or soft fouling types. Calcareous (hard) fouling organisms include barnacles, encrusting bryozoans, mollusks, polychaete and other tube worms, and zebra mussels. Examples of non-calcareous (soft) fouling organisms are seaweed, hydroids, algae and biofilm "slime". Together, these organisms form a fouling community and cause serious damage, including infiltration of the equipment with roots and other attachment systems, contribute to excess weight and frictional drag, and can lead to catastrophic equipment failure. Indeed, failure of the Alexander Kielland and Ocean Ranger oil production platforms has been attributed in part due to biofouling, both from increased load and windage, as well as from damage that was hidden under the thick fouling layer.

For example, the degradation of wooden pilings and docks by wood-boring organisms in marine environments has been a well-known problem for centuries. The *Limnoria Tripunctata* (crustacean borer) and the *Teredinidae* (borer shipworm, a bivalve borer) are two of the most common destructive organisms found in US regional waterways, as both types of borers attack wood for shelter and food. These organisms are responsible for hundreds of millions of dollars in damage to wooden marine structures. In fact, the life expectancy of an unwrapped chromated-copper-arsenate and/or ammoniacal-copper-zinc-arsenate "pressure-treated" piling that is fully exposed to the elements is only seven to ten years.

Even steel and concrete pilings are subject to considerable wear-and-tear in a marine environment. The spray and splash zone above the mean high tide level is the most severely attacked region due to continuous contact with highly aerated sea water and the erosive effects of spray, waves and tidal action. Steel corrosion rates as high as 0.9 mm/year at Cook Inlet, Alaska, and 1.4 mm/year in the Gulf of Mexico have been reported. Cathodic protection in this area is ineffective because of lack of continuous contact with the seawater, the electrolyte, and thus no current flows for much of the time. Corrosion rates of bare steel pilings are often also very high at a position just below mean low tide in a region that is very anodic relative to the tidal zone, due to powerful differential aeration cells which form in the well aerated tidal region.

Barnacle accretion is reduced on concrete pillars, as compared with steel pillars (see FIG. 2). However, concrete has other difficulties. Concrete exposed to marine environment may deteriorate as a result of combined effects of chemical action of seawater constituents on cement hydration products, alkali-aggregate expansion (when reactive aggregates are present), crystallization pressure of salts within concrete if one face of the structure is subject to wetting and others to drying conditions, frost action in cold climates, corrosion of embedded steel in reinforced or prestressed members, and physical erosion due to wave action and floating objects.

Thus, fouling, erosion and corrosion causes significant structural damage to marine equipment, such as pilings. Furthermore, the weight and loadings that result from fouling can be so significant as to necessitate considerable 'over-design' of such structures compared to what would otherwise be required.

Thus, marine equipment must be periodically inspected and cleaned to keep biofouling to a minimum. High pressure water blasters and handheld scrapers have proven to be effective in-water tools for the removal of fouling from a range of structures (including oil rigs). However, such methods are tedious and require considerable manpower and/or submersible equipment, both of which are expensive. Dry-docking and land-based cleaning methods such as sand blasting are the other option, but obviously this requires considerable downtime, and can be impractical for many nearshore and offshore oil exploration and production equipment.

Another option is to provide protective coatings for marine pilings. Cuprotect®, for example, is a polyurethane coating that can be applied to a piling like paint. However, coatings have a limited lifespan, and once the coating has lost efficacy, the problem reemerges.

Another potentially effective method is plastic wrapping. Vessels in many size categories, as well as artificial structures (e.g. wharf piles, moorings, fish farming cages) have been treated in situ by encapsulating them in plastic wrapping. The method relies on the development of anoxic conditions in the encapsulated water and, if necessary, mortality can be accelerated through the addition of non-persistent chemical agents (e.g. acetic acid and bleach). However, the practicality and efficacy of this concept being applied to a marine structure of the dimensions of a semi-submersible drilling rig is yet to be established by any detailed research or experimentation. Further work is also required to clarify the factors that influence mortality rates (e.g. temperature, fouling biomass) so that informed treatment guidelines can be developed.

Other plastic wrap methods have been proposed. U.S. Pat. No. 2,724,156, for example describes a single layer tough flexible waterproof pole boot. U.S. Pat. No. 5,180,531 describes extruding a continuous, substantially homogeneous plastic layer at least two inches thick on substantially the entire length of a steel core of a piling.

U.S. Pat. No. 7,300,229 describes a repair jacket for spot repair of a piling which includes a cylindrical body of fiber-reinforced plastic (FRP) material that is about 0.5 to 3.5 inches greater in diameter than the piling. The body is wrapped around the piling, sealed and filled with expanding grout to create a rigid seal at the bottom of the gap. Similarly, U.S. Pat. No. 7,871,483 describes using a plastic shrink wrap for spot repair.

A high density polyethylene material that is 0.030" thick and is available in both 36" and 60" widths is available to wrap wooden pilings. However, the pile is wrapped using roofing nails, and for best results, the manufacturer instructs that nails should be installed every 2" along the seams. Thus, this piling is not easily removed, and is usable for only a single protective session.

Similarly, U.S. Pat. No. 6,872,030 describes a composite wrapping, formed on the piling by a filament winding process. Filament strands are impregnated with resin and wrapped around the wood piling under tension. The resin is allowed to cure to form a seamless layer which is uniform in thickness and materials. This method is fairly complex, and thus impractical for larger marine structures more complicated than a simple pole. Further, it cannot be easily applied to existing structures.

Another solution is to replace wooden pilings with other materials, less susceptible to biofouling. For example, fiberglass pilings are available and are impervious to any borers and worms. However, barnacles and other marine organisms are still a problem, and are still difficult to remove if left for any length of time. Further, as noted above, even steel and concrete pilings are subject to extreme wear in a marine environment.

None of the above solutions address the need for a simple easy way of cleaning pilings, without having to pull the pilings to dry dock for maintenance or spend significant amount of dive time cleaning the pilings underwater. Any method can reduce the frequency at which pilings are dry docked or cleaned in situ would be of tremendous cost and time savings.

SUMMARY OF THE DISCLOSURE

Generally speaking, the invention is related to multi-layered plastic wrapping that can easily be peeled off marine and other equipment in situ, one layer at a time. A three-layer wrapping could thus treble the length of time between dry-docking, or in situ cleaning sessions, thus effectively saving cleaning and down time costs. Furthermore, the plastic wrapping is an inexpensive material, easily added to equipment at manufacture or after a dry dock cleaning session.

The film can be a shrink wrap film or a pressure adhesive film as desired. The shrink wrap is preferred as easily fittable to complex structures and shapes. Shrink wrap, also known as shrinkwrap or shrink film, is a material made up of polymer plastic film, that shrinks tightly over whatever it is covering when heat is applied. Heat can be applied with a hand held heat gun (electric or gas) or the product and film can pass through a heat tunnel on a conveyor.

The most commonly used shrink-wrap materials are POF, PVC, PE, BOPP films and several other compositions. Laminate structures are also possible. It is preferred that at least the exterior layer (and preferably both sides) of the plastic film layer be as smooth as possible (e.g., non-porous), because this minimizes sheet layers adhering to each other, but also because it minimizes the initial bacterial and algal colonization of the smooth surfaces, thus reducing biofilm formation and delaying the onset of macrofouling organisms.

Exemplary shrink-wrap films include styrene butadiene block copolymers (US20110098401); and star-shaped butadiene-styrene block copolymers having random styrene-butadiene blocks (U.S. Pat. No. 7,037,980). Further, several marine quality shrink-wrap films are already available, e.g., 7 mil polyethlylene films are available from ULINE, Jamestown Distributer, Pro-Tect, BIG-SHRINK.COM, to name a few suppliers. Thicker, e.g., 9, 10, 12 mil films are also available, and even thicker films (15-20 mil) can be made on request.

In some embodiments, the film contains a marine organism retardant, such as silicone fluids and silicone resins (U.S. Pat. No. 5,298,060). Metals have often been used for marine retardants, e.g., copper, organotin compounds, or other biocides. However, these are not preferred as contributing to water pollution and possibly harming local marine life. In fact, both copper ions and synthetic biocides accumulate in the coastal water and in the sediments. For this reason, the particularly toxic tributyltin (TBT) has been banned since 2008 and the currently preferred and still permitted copper oxide containing coatings are to be replaced by non-toxic alternatives in the near future. EPaint®, which has been used by the US Coast Guard, works by producing hydrogen peroxide in the presence of light. Seaguard®—a high-solids (80 percent) epoxy—is another less toxic alternative, as is capsicum (from peppers).

The shrink-wrap can be removable with any means known in the art, provided the method is applicable to a single layer at a time. One means of removing plastic film is with the use of perforations, wherein the perforations are staggered on each layer so that any one layer of perforations does not expose the piling or other marine equipment along the perforated line (U.S. Pat. No. 8,511,472).

However, a preferred method of removal is the use of a filament embedded in the plastic, which can be used to cut through the plastic layer when pulled. U.S. Pat. No. 7,914,638, U.S. Pat. No. 8,187,407 and U.S. Pat. No. 8,361,615, for example, each describe vehicle wrapping that contains therein a "knifeless tape" for quick cutting of the wrapping film. A vehicle is wrapped with adhesive film where the film is also applied over doors and other areas intended not to be covered. The film is cut at the door edge and over the area by adhesively attaching a tape having a release coating on the front surface and carrying a filament along a center of the front side.

The filament can be formed of any suitable material, which has sufficient strength to carry out the cutting action without breaking and a sufficient cutting action to effect cutting and not tearing the film. Metal wire is typically suitable. Other materials such as carbon fiber or Kevlar fiber can be used. MOPP (mono-axially oriented polypropylene) may be preferred.

In other embodiments, the removal strip can be omitted, and the plastic film cut with a suitable protected cutting blade, such as is typically used to cut films (see FIG. 3). Such embodiment may be particularly useful where sheets are separated by a release liner, which will provide a small space into which the blade guide can be inserted. Alternatively, a small plastic cable can be placed between the layers, the cable also providing a small space for insertion of a cutting blade. For greater spacing, the cable can be provided with a groove or depression into which a cutting edge can be fit. This is particularly preferred because the raised edges also guide the cutting blade, ensuring a straight cut.

For particularly complex riggings, such as the lattice pilings on a jack-up rig, a spray on plastic coating can be combined with wire release tapes. The wire is laid down first, and then a layer of spray on resin applied, and fully cured. If necessary, a layer of non-stick material is coated or dusted thereon or a release liner is laid down, and a second wire or cable (staggered to the first) and spray coat is applied, and so on until the requisite numbers of wrappings has been layered thereon. Alternatively, the entirety of a lattice structure, such as a leg, can be enclosed inside multilayer wrapping, rather than wrapping individual tubes of the lattice structure.

For simpler shapes, sheets of films can be applied, seamed if needed, with the seaming tapes readily available, and the knifeless tape added thereto. For simple structures with fixed external equipment mounted thereon, such as concrete gravity structures, which have concrete pillars that may have ladders and pipes mounted thereon, a number of wire release tapes can be used so as to release film layers without the need to remove these mounted structures.

Non-stick or release-coating coatings may be needed to prevent the layers from sticking together, thus allowing their easy removable, even after several months at high pressures. Release materials include the use of spray on PTFE (e.g., Teflon®) and other fluoropolymer coatings, solvent suspended powders that can be applied by spray, silica coatings, release coating, silicone coatings, release papers, release liners, SILCOLEASE® and the like.

As used herein, "removal strip" means any mechanism or device for allowing the film to be cut or otherwise separated along the strip for removal of a layer. Such removal strips include a line of perforations, a wire embedded within or under the film layer, such as is described in U.S. Pat. No. 7,914,638, U.S. Pat. No. 8,187,407 and U.S. Pat. No. 8,361,615, or a plastic cable or other device to raise the layer slightly along or inside the strip for insertion of a cutting blade. Removal strips typically travel from one end of a layer to the other, preferably in a straight line, but they can also spiral around a piling, and multiple intersecting removal strips can be used for larger or more complex shapes. Spiral wraps may be particularly beneficial for piling that are too long for the width of film available.

As used herein a "release layer" is a layer of material between the layers allowing easy separation of the layers. Such includes "release coatings," such as Teflon, silicone, silica, and the like, and "release liners," such as wax or teflon coated paper.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, logos, packaging materials, a cutting blade, and the like.

The following abbreviations are used herein:

| ABBREVIATION | TERM |
|---|---|
| BOPP | biaxially oriented polypropylene |
| HDPE | High Density PE |
| MDPE | Medium density PE |
| PE | polyethylene |
| PFA | Perfluoroalkoxy |
| POF | polyolefin |
| PTFE | Polytetrafluoroethylene |
| PVC | Polyvinyl chloride |

BRIEF DESCRIPTION OF THE DRAWINGS

FIG. 2. Biofouling mass on 90-10 Cu—Ni sheathed Steel pilings at 5 and 10 years, from Powers.

FIG. 6B shows a knife inserted into the space created by the removal strip, which can now be used to slice through and remove the outermost layer.

DETAILED DESCRIPTION

Figure 1:
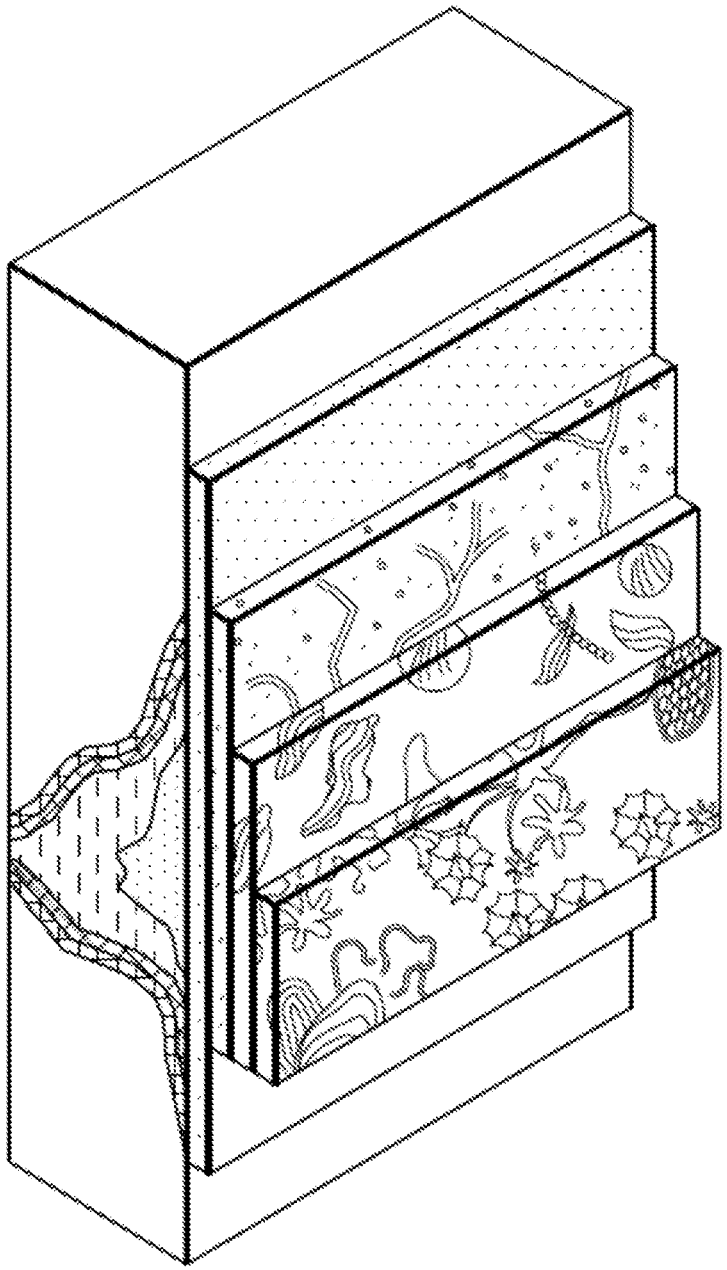
FIG. 1. Schematic of the four main stages of biofouling, from Brujis (2006).

The disclosure provides novel multilayer wrappings that can be used wherever regular maintenance of equipment is needed. The multi-wrapped layers are preferably equipped with a removal strip for easy removal of a single layer at a time, and the removal strips are preferably staggered in subsequent layers.

The present invention is exemplified with respect to a simple concrete piling, such as might be used on near-shore construction or offshore concrete gravity structures, as well as with a lattice-type piling such as is typical on jack-up rigs. However, this is exemplary only, and the invention can be broadly applied to any submerged marine structure that can benefit from fewer cleaning cycles.

The invention comprises one or more of the following embodiments, in any combination thereof.

- A marine protective covering, said covering comprising a plurality of layers of plastic film, each layer having a removal strip associated therewith, the layers arranged so that removal strips do not overlap each other (although they may cross) and so that a single outermost layer can be removed using an outermost removal strip.
- The marine protective covering comprising a release layer between each layer of plastic film.
- The marine protective covering, said release layer being a release liner or a release coating.
- The marine protective covering, wherein said plastic film is shrink wrap film.
- The marine protective, wherein the removal strip comprises a line of perforations.
- The marine protective covering comprising three, four, five, six, seven, eight, ten or more layers of plastic film.

The marine protective covering wherein the removal strip comprises a line of filament, preferably wire filament, and a grippable tab at one end for gripping and pulling so as to cut said plastic film.

The marine protective covering wherein said plastic film is shrink wrap film, wherein said removal strip comprises a line of filament embedded under said plastic film, said filament having a grippable tab at one end for gripping and pulling so as to cut said plastic film.

The marine protective covering, wherein said plastic film is shrink wrap film, wherein said removal strip comprises a line of filament embedded under said plastic film, said filament having a grippable tab at one end for gripping and pulling so as to cut said plastic film, and wherein a release layer is provided between each layer of plastic film.

A method of protecting a device, said method comprising i) applying a first layer of shrink wrap film having a removal strip associated therewith over a device, ii) applying a second layer of heat shrink film having a removal strip therein over said device, such that said removal strips are at least partially staggered, and iii) repeating step ii) for as many layers of plastic protection are desired.

A method, wherein said plastic film is shrink wrap film, and said method further comprising heat shrinking said shrink wrap film over said device before applying an additional layer of shrink wrap film.

A method, said method further comprising adding a release layer before applying said second layer.

A method of protecting a storage tank or piling, said method comprising i) applying a first layer of shrink wrap film having a first removal strip associated therewith over a storage tank or piling, ii) heat shrinking said first layer of shrink wrap film over said storage tank or piling, iii) applying a second layer of heat shrink film having a second removal strip associated therewith over said storage tank or piling, such that said first and second removal strips are at least partially staggered, iv) heat shrinking said second layer of shrink wrap film over said storage tank or piling, and repeating for as many layers of plastic protection are desired.

Figure 3A:
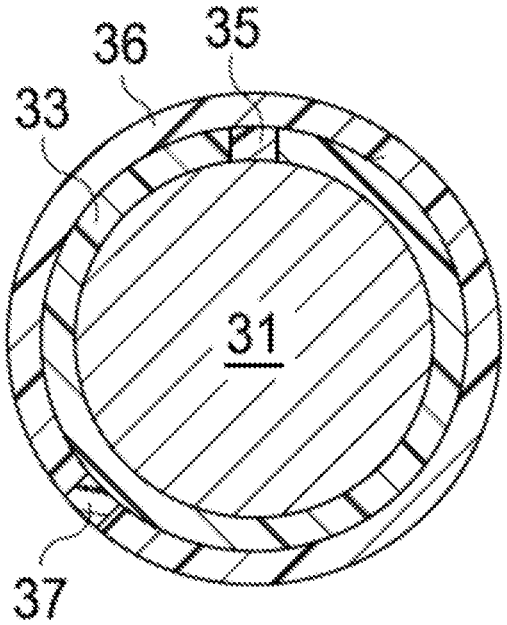
FIGS. 3A and 3B show cross section and perspective views of a dual wrapped piling.
Figure 3B:
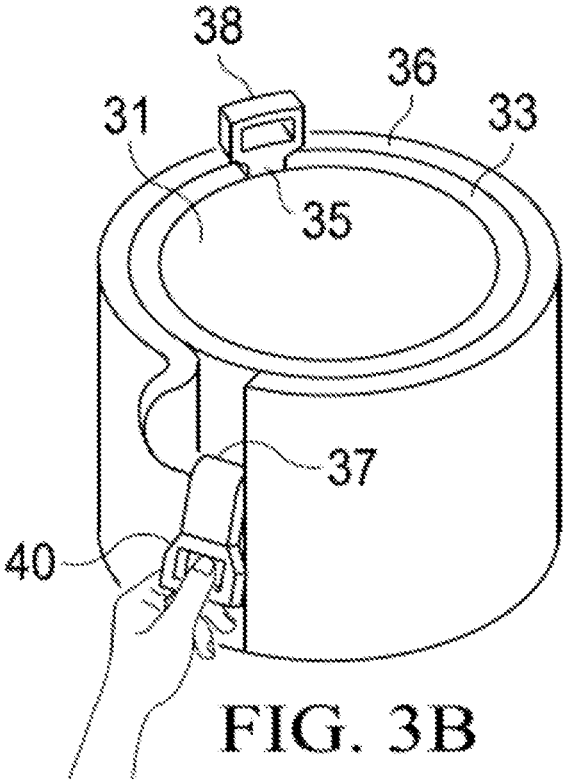

FIG. 3A shows a cross section of piling 31 wrapped with a first layer of plastic 33 and a second layer 36. Removal strips 35 and 37 allow sequential removal of one layer at a time. In FIG. 3B the removal strip 35 has a tab 38 at one end for easy grip. To remove outermost layer 36, the user grips tab 40, pulling down on removal strip 37 which separates layer 36 allowing it to be peeled off.

Figure 4A:
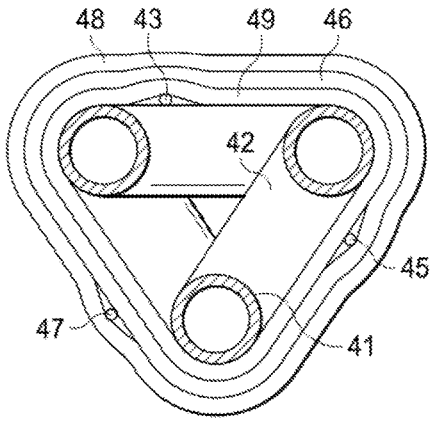
FIGS. 4A and 4B show cross section and perspective views of a triple layer wrapped truss leg.
Figure 4B:
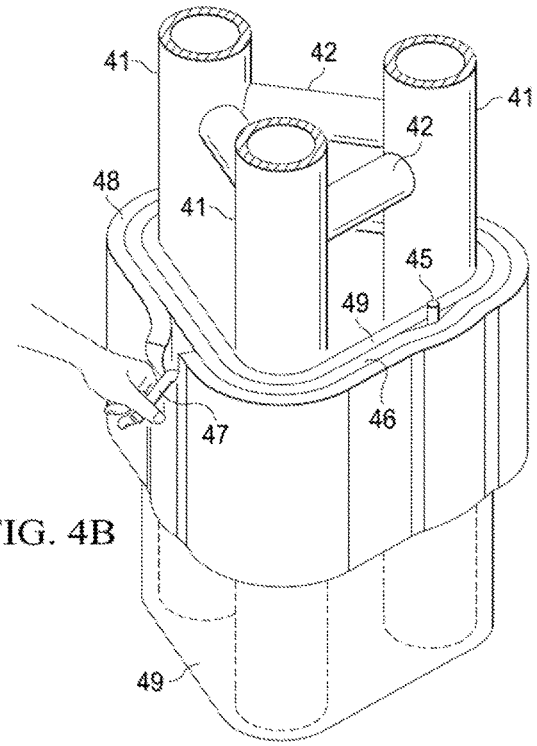

FIG. 4A shows a cross section of a wrapper truss leg comprised of vertical tubes 41 connected by latticed tubes 42. A cutting removal strip (wire shown) 43, 45, 47 is under each layer 49, 36, 48. A perspective view is shown in FIG. 4B, which shows a user pulling removal strip 47, which then cuts outer layer 48, allowing it to be removed.

Figure 5:
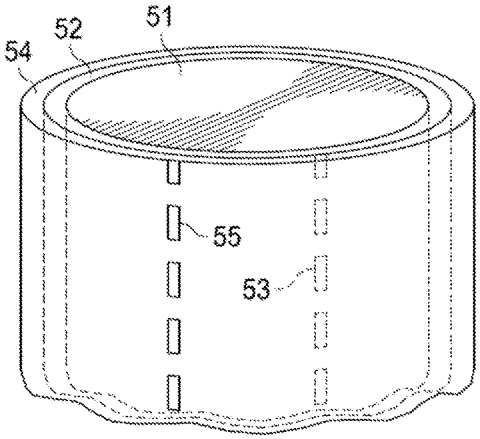
FIG. 5 shows a dual wrapped piling wherein layers are perforated for easy removal.

FIG. 5 shows another embodiment wherein piling 51 is encased in layers 52, 54. Removal strips 55 and 53 are a line of perforations.

Figure 6A:
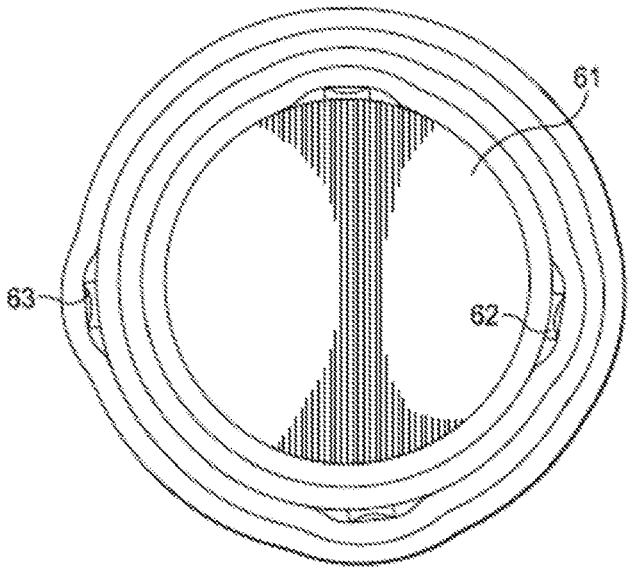
FIGS. 6A and 6B show a top and side views of a four layer wrapped piling with a removal strip under each layer.
Figure 6B:
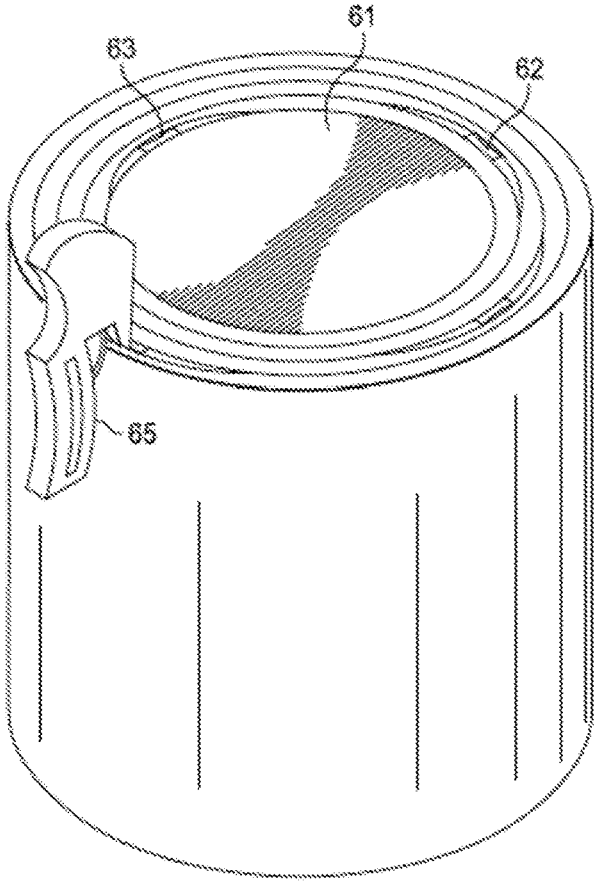

FIG. 6A shows a top view of a piling 61 with four layers of plastic. Under each layer is a removal strip 62 that has a small depression 63 into which a cutting edged can be inserted. FIG. 6B shows knife 665 inserted into this small space 63, ready to slice open the outermost layer.

The following references are incorporated by reference in their entireties for all purposes.

Powers & Michels REVIEW OF SPLASH ZONE CORROSION AND BIOFOULING OF C70600 SHEATHED STEEL DURING 20 YEARS EXPOSURE, online at copper.org/applications/marine/cuni/pdf/splash_zone michels_powell.pdf Brujis Pre-survey of marine fouling on turbine support structures of the Offshore Windfarm Egmond aan Zee (2006), available online at noordzeewind.nl/wp-content/uploads/2012/02/OWEZ_R_112_20060725.pdf U.S. Pat. No. 2,724,156

U.S. Pat. No. 5,180,531

U.S. Pat. No. 7,300,229

U.S. Pat. No. 7,871,483

U.S. Pat. No. 6,872,030

US20110098401

U.S. Pat. No. 7,037,980

U.S. Pat. No. 5,298,060

U.S. Pat. No. 8,511,472

U.S. Pat. No. 7,914,638, U.S. Pat. No. 8,187,407 and U.S. Pat. No. 8,361,615

What is claimed is:

1. A marine protective covering, said covering surrounding a marine piling and comprising a plurality of layers of plastic film, every two layers having a removal strip associated therebetween, the layers arranged so that removal strips are staggered in location with respect to one another and so that a single outermost layer can be removed from said marine piling using an outermost removal strip.

2. The marine protective covering of claim 1, further comprising a release layer between every two layers of plastic film.

3. The marine protective covering of claim 2, said release layer being a release liner.

4. The marine protective covering of claim 2, said release layer being a release coating.

5. The marine protective covering of claim 1, wherein said plastic film is shrink wrap film.

6. The marine protective covering of claim 1, wherein said removal strip comprises a line of perforations.

7. The marine protective covering of claim 1, wherein the plurality of layers comprise three layers of plastic film.

8. The marine protective covering of claim 1, wherein the plurality of layers comprise four layers of plastic film.

9. The marine protective covering of claim 1, wherein the plurality of layers comprise five layers of plastic film.

10. The marine protective covering of claim 1, wherein said removal strip comprises a line of filament having a grippable tab at one end for gripping and pulling so as to cut said plastic film with said filament.

11. The marine protective covering of claim 1, wherein said plastic film is shrink wrap film, wherein said removal strip comprises a line of filament embedded under said plastic film, said filament having a grippable tab at one end for gripping and pulling so as to cut said plastic film.

12. The marine protective covering of claim 1, wherein said plastic film is shrink wrap film, wherein said removal strip comprises a line of filament embedded under said plastic film, said filament having a grippable tab at one end for gripping and pulling so as to cut said plastic film, and wherein a release layer is provided between each layer of plastic film.

13. A method of protecting a device, said method comprising a) applying a first layer of plastic film over a device, b) applying a first removal strip over said first layer, c) applying a second layer of plastic film over said second device, d) applying a second removal strip over said second layer, such that said first and second removal strips are at least partially staggered with respect one another, e) repeating step c and d for as many additional layers of plastic protection are desired.

14. The method of claim 13, wherein said plastic film is shrink wrap film, and said method further comprising heat shrinking said shrink wrap film over said device before applying an additional layer of shrink wrap film.

15. The method of claim 13 or 14, said method further comprising step b2) adding a release layer before proceeding to step c).

16. A method of protecting a storage tank or piling, said method comprising a) applying a first layer of shrink wrap film having a first removal strip associated therewith over a storage tank or piling, b) heat shrinking said first layer of shrink wrap film over said storage tank or piling, c) applying a second layer of heat shrink film having a second removal strip associated therewith over said storage tank or piling, such that said first and second removal strips are at least partially staggered, d) heat shrinking said second layer of shrink wrap film over said storage tank or piling, and e) repeating steps c-d for as many layers of plastic protection are desired.

17. The method of claim 16, further comprising step b2) and d2) adding a release layer over said storage tank or piling.

* * * * *